US011528785B2

(12) United States Patent
Nakajima et al.

(10) Patent No.: US 11,528,785 B2
(45) Date of Patent: Dec. 13, 2022

(54) HEATING COOKER, METHOD OF CONTROLLING HEATING COOKER, AND HEATING COOKING SYSTEM

(71) Applicant: Panasonic Intellectual Property Management Co., Ltd., Osaka (JP)

(72) Inventors: Shota Nakajima, Saitama (JP); Hirohisa Imai, Shiga (JP); Gantetsu Matsui, Kyoto (JP); Hirokazu Kusuura, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 342 days.

(21) Appl. No.: 16/086,984

(22) PCT Filed: Apr. 4, 2017

(86) PCT No.: PCT/JP2017/014056
§ 371 (c)(1),
(2) Date: Sep. 20, 2018

(87) PCT Pub. No.: WO2017/179460
PCT Pub. Date: Oct. 19, 2017

(65) Prior Publication Data

US 2019/0098708 A1 Mar. 28, 2019

(30) Foreign Application Priority Data

Apr. 11, 2016 (JP) ..... JP2016-078542

(51) Int. Cl.
*H05B 6/64* (2006.01)
*F27D 21/00* (2006.01)
(Continued)

(52) U.S. Cl.
CPC ..... *H05B 6/6441* (2013.01); *F27D 21/00* (2013.01); *F27D 21/02* (2013.01); *H05B 6/6447* (2013.01);
(Continued)

(58) Field of Classification Search
CPC .... H05B 6/6447; H05B 6/705; H05B 6/6482; H05B 6/6435; H05B 6/6455; H05B 6/687;
(Continued)

(56) References Cited

U.S. PATENT DOCUMENTS 6,249,710 B1 * 6/2001 Drucker ..... H05B 6/668 700/15
6,274,859 B1 * 8/2001 Yoshino ..... H05B 6/66 219/746
(Continued)

FOREIGN PATENT DOCUMENTS

JP 61114016 A * 5/1986 ..... F24C 7/08
JP 2001-349546 12/2001

OTHER PUBLICATIONS

International Search Report of PCT application No. PCT/JP2017/014056 dated Jul. 11, 2017.

*Primary Examiner* — Chris Q Liu
(74) *Attorney, Agent, or Firm* — McDermott Will & Emery LLP

(57) ABSTRACT

A heating cooker according to the present disclosure includes a heating chamber, a heating unit, a capturing unit, a control unit, an appearance characteristic analysis unit that analyzes an appearance characteristic of a heated material, an information reading unit that reads heating control information, an information storage unit in which an acceptable range of the heating control information is registered, and an information determination unit that determines whether the heating control information read by the information reading
(Continued)

unit is within the acceptable range. When the heating control information read by the information reading unit is within the acceptable range, the control unit executes heating control based on the heating control information read by the information reading unit. When the heating control information read by the information reading unit is not within the acceptable range, the control unit does not execute heating control based on the heating control information read by the information reading unit.

7 Claims, 10 Drawing Sheets

(51) Int. Cl.
*H05B 6/68* (2006.01)
*H05B 6/66* (2006.01)
*F27D 21/02* (2006.01)

(52) U.S. Cl.
CPC ..... *H05B 6/668* (2013.01); *H05B 6/687* (2013.01); *F27D 2021/026* (2013.01)

(58) Field of Classification Search
CPC .... H05B 6/6458; H05B 6/688; H05B 6/6402; H05B 6/6441; H05B 6/645; H05B 6/6464; H05B 6/68; H05B 6/686; H05B 6/72; H05B 6/6411; H05B 6/6479; H05B 6/70; H05B 2206/044; H05B 3/148; H05B 6/64; H05B 6/66; H05B 1/02; H05B 1/0263; H05B 2206/045; H05B 2206/046; H05B 3/0076; H05B 6/00; H05B 6/129; H05B 6/6408; H05B 6/6426; H05B 6/6438; H05B 6/6452; H05B 6/647; H05B 6/6473; H05B 6/6485; H05B 6/6488; H05B 6/664; H05B 6/666; H05B 6/668; H05B 6/74; H05B 6/80; H05B 6/808
USPC ..... 219/685, 702, 704, 705, 506, 707, 720, 219/762, 392, 400, 494, 518, 678, 751, 219/754, 214, 385, 386, 401, 404, 411, 219/413, 490, 502, 601, 626, 680, 682, 219/708, 710, 711, 719, 732, 746, 750, 219/752, 753, 763; 99/325, 468, 331, 99/451, 327, 348, 448, 483
See application file for complete search history.

(56) References Cited

U.S. PATENT DOCUMENTS

2007/0007279 A1* 1/2007 Chun ..... H05B 6/6441 219/506
2007/0029306 A1* 2/2007 Chun ..... H05B 6/6441 219/506
2007/0114224 A1* 5/2007 Nagamitsu ..... G06V 40/28 219/490
2009/0134151 A1* 5/2009 Bogatin ..... F24C 15/325 219/681
2010/0187224 A1* 7/2010 Hyde ..... H05B 6/6455 219/720
2011/0002677 A1* 1/2011 Cochran ..... A47J 37/0623 392/416
2011/0022211 A1* 1/2011 McIntyre ..... H05B 6/688 700/108
2012/0125921 A1* 5/2012 Shim ..... H05B 6/705 219/702
2013/0092682 A1* 4/2013 Mills ..... H05B 1/0263 219/702
2013/0186887 A1* 7/2013 Hallgren ..... H05B 6/6447 219/702
2014/0203012 A1* 7/2014 Corona ..... A23L 5/15 219/704
2015/0160624 A1* 6/2015 Nonaka ..... H05B 6/6441 700/9
2015/0289324 A1* 10/2015 Rober ..... H05B 6/68 219/711
2016/0073453 A1* 3/2016 Hyde ..... H05B 6/645 219/745
2016/0283822 A1* 9/2016 Imai ..... H05B 6/6447
2016/0302265 A1* 10/2016 Kreiner ..... H05B 6/6455
2016/0353921 A1* 12/2016 Dodge ..... A47J 36/321
2017/0108351 A1* 4/2017 Shimizu ..... G01D 4/002

* cited by examiner

FIG. 6

601

| No | OCCUPANCY | ACCEPTABLE LOWER LIMIT VALUE (W × NUMBER OF SECONDS OF HEATING) | ACCEPTABLE UPPER LIMIT VALUE (W × NUMBER OF SECONDS OF HEATING) |
|---|---|---|---|
| 1 | 0~10% | 0 | 0 |
| 2 | 10~30% | 7000 | 47000 |
| 3 | 30~60% | 15000 | 150000 |
| 4 | 60~90% | 30000 | 210000 |
| 5 | 90~% | 54000 | 300000 |

FIG. 9

901

| No | OCCUPANCY | SHAPE | ACCEPTABLE LOWER LIMIT VALUE (W × NUMBER OF SECONDS OF HEATING) | ACCEPTABLE UPPER LIMIT VALUE (W × NUMBER OF SECONDS OF HEATING) |
|---|---|---|---|---|
| 1 | 0~10% | any | 0 | 0 |
| 2 | 10~30% | (TRIANGLE) | 5000 | 30000 |
| 3 | | SHAPES OTHER THAN SPECIFIED SHAPE | 7000 | 47000 |
| 4 | 30~60% | (RECTANGLE) | 25000 | 90000 |
| 5 | | (CIRCLE) | 45000 | 180000 |
| 6 | | SHAPES OTHER THAN SPECIFIED SHAPE | 15000 | 150000 |
| 7 | 60~90% | any | 30000 | 210000 |
| 8 | 90~% | any | 54000 | 300000 |

1101

| No | COLOR OF CONTAINER | SHAPE OF CONTAINER | OCCUPANCY | ACCEPTABLE LOWER LIMIT VALUE (W × NUMBER OF SECONDS OF HEATING) | ACCEPTABLE UPPER LIMIT VALUE (W × NUMBER OF SECONDS OF HEATING) |
|---|---|---|---|---|---|
| 1 | WHITE | FOLLOWING SPECIFIED SHAPES  OR  OR  OR  | 0~10% | 0 | 0 |
| 2 | | | 10~30% | 7000 | 47000 |
| 3 | | | 30~60% | 15000 | 150000 |
| 4 | | | 60~90% | 30000 | 210000 |
| 5 | | | 90~% | 54000 | 300000 |
| 6 | | SHAPES OTHER THAN SPECIFIED SHAPE | any | - | - |
| 7 | COLORS OTHER THAN WHITE | any | any | - | - |

HEATING COOKER, METHOD OF CONTROLLING HEATING COOKER, AND HEATING COOKING SYSTEM

This application is a U.S. national stage application of the PCT International Application No. PCT/JP2017/014056 filed on Apr. 4, 2017, which claims the benefit of foreign priority of Japanese patent application No. 2016-078542 filed on Apr. 11, 2016, the contents all of which are incorporated herein by reference.

TECHNICAL FIELD

The present disclosure relates to a heating cooker that recognizes an image captured by a camera and executes heating control based on a recognition result, a method of controlling a heating cooker, and a heating cooking system.

BACKGROUND ART

In a microwave oven, which is an example of heating cookers, when a user inputs a heating time or the like and presses a button for starting heating, heating cooking starts. In stores such as convenience stores and supermarkets selling boxed lunches and packed daily dishes, a store clerk (a user) provides a service of heating and cooking using a microwave oven a food purchased by a customer and then giving the food to the customer.

However, there is a problem that it is troublesome for a user to input a heating time or the like to a microwave oven.

Consequently, it has been proposed a microwave oven that includes a reading unit reading information of a barcode attached to a product and a storage unit storing in advance a heating control content corresponding to the information of the barcode. This conventional microwave oven reads code information of a food using a barcode reader, sets a heating control content corresponding to the food based on the code information, and performs appropriate heating.

In addition, it has been proposed a microwave oven that does not use a barcode reader but a camera capturing a chamber of the microwave oven (for example, PTL 1). This conventional microwave oven extracts a barcode part from an image of a food put in the chamber to read a barcode. This conventional microwave oven sets a heating control content corresponding to the food based on code information and performs appropriate heating. It is thus possible to reduce a burden in operation on a store clerk.

However, the microwave oven described in PTL 1 uses a camera to read a barcode, and thus due to various factors including a position of a food disposed, an angle of a food label, and a state of printing, different content from a heating control content stored in a barcode might be read. If a barcode is misread, heating control that is totally different from original heating control is executed.

CITATION LIST

Patent Literature

PTL 1: Unexamined Japanese Patent Publication No. 2001-349546

SUMMARY OF THE INVENTION

A heating cooker of the present disclosure includes a heating chamber, a heating unit that heats a heated material in the heating chamber, a capturing unit that captures the heating chamber, a control unit that controls at least heating by the heating unit, an appearance characteristic analysis unit that analyzes an appearance characteristic of the heated material based on an image captured by the capturing unit, an information reading unit that reads heating control information applied to the heated material from the image captured by the capturing unit, an information storage unit in which an acceptable range of the heating control information corresponding to the appearance characteristic is registered, and an information determination unit that determines whether the heating control information read by the information reading unit is within the acceptable range. When the heating control information read by the information reading unit is within the acceptable range, the control unit executes heating control based on the heating control information read by the information reading unit. When the heating control information read by the information reading unit is not within the acceptable range, the control unit does not execute heating control based on the heating control information read by the information reading unit.

According to the present disclosure, it is possible to provide a heating cooker that prevents heating cooking from being performed using misrecognized heating control information and that heats and cooks a food with a reduced burden in operation on a user.

BRIEF DESCRIPTION OF DRAWINGS

FIG. 6 shows a table of correlations of an occupancy with a range of heating set values in the heating cooker.

FIG. 9 shows a table of correlations of a plurality of appearance characteristics with ranges of heating set values in the heating cooker according to the second exemplary embodiment of the present disclosure.

DESCRIPTION OF EMBODIMENTS

Hereinafter, exemplary embodiments of the present disclosure will be described with reference to the drawings. The present disclosure is not limited to the exemplary embodiments.

First Exemplary Embodiment

Figure 1:
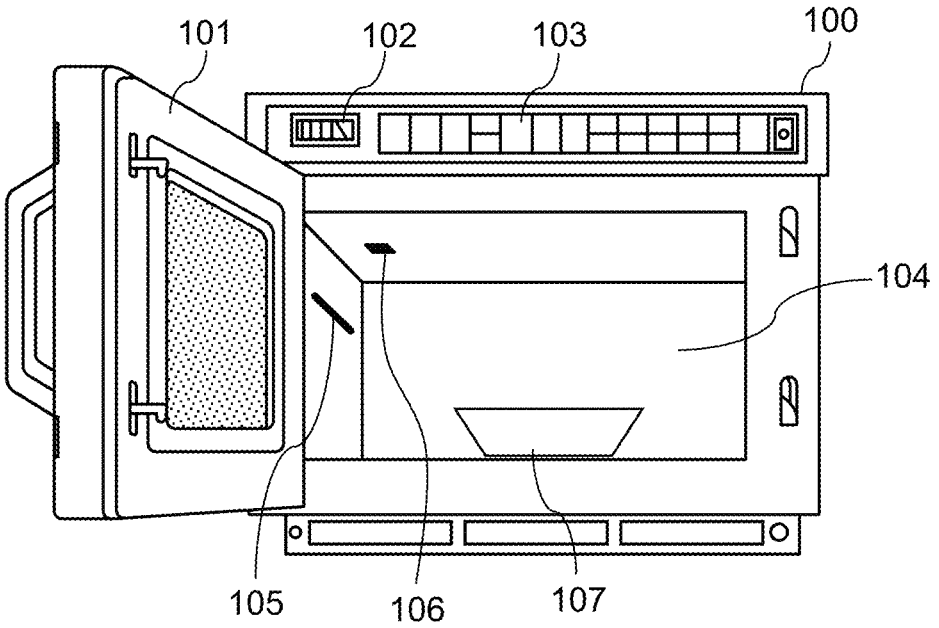
FIG. 1 is a front view showing an appearance of a heating cooker according to a first exemplary embodiment of the present disclosure.

FIG. 1 is a front view showing an appearance of a microwave oven, which is an example of a heating cooker according to the present exemplary embodiment.

As shown in FIG. 1, door panel 101 is formed on a front surface of heating cooker 100 so that a user can put or take a food (heated material) in or out of a housing storing the food. Heating cooker 100 includes heating information display unit 102 and selection unit 103 above door panel 101.

As described later, heating cooker 100 reads an amount of heating and a heating time from a label on a food or the like, and heats and cooks the food at a set amount of heating for a set heating time. Heating information display unit 102 displays a read heating time.

Selection unit 103 includes a "menu" button for enabling a user to select a corresponding food when the amount of heating or the heating time cannot be read or the like, and a numeral button, a "minute" button, and a "second" button for manually setting the heating time. In addition, selection unit 103 also includes a "heating start button" for starting heating and a "heating stop button" for stopping heating.

Heating cooker 100 includes heating cooking chamber 104 in the housing. In heating cooking chamber 104, illumination unit 105 is provided on a side surface of the chamber and camera 106 is provided on a top surface of the chamber. Camera 106 is installed at a top part of the chamber of heating cooking chamber 104, and thus camera 106 captures the entire chamber from the top part of the chamber. Camera 106 is electrically connected to a camera control circuit (not shown) and is controlled by the camera control circuit.

A display for prompting a user to place a food on a center part of a bottom surface of heating cooking chamber 104 is provided on the bottom surface of heating cooking chamber 104. For example, the bottom surface includes a display such as "please place food at center" and lines showing four corners of a center area for clearly defining the center area (see FIG. 5A to be described later).

Camera 106 captures food 107 stored in heating cooking chamber 104. Heating cooker 100 detects heating control information and an appearance characteristic about food 107 based on image information captured.

Heating cooker 100 includes illumination unit 105 for illuminating interior of heating cooking chamber 104. For example, illumination unit 105 is disposed on the side surface of heating cooking chamber 104 as shown in FIG. 1, for the purpose of illuminating the entire chamber from the side surface of the chamber.

Figure 2:
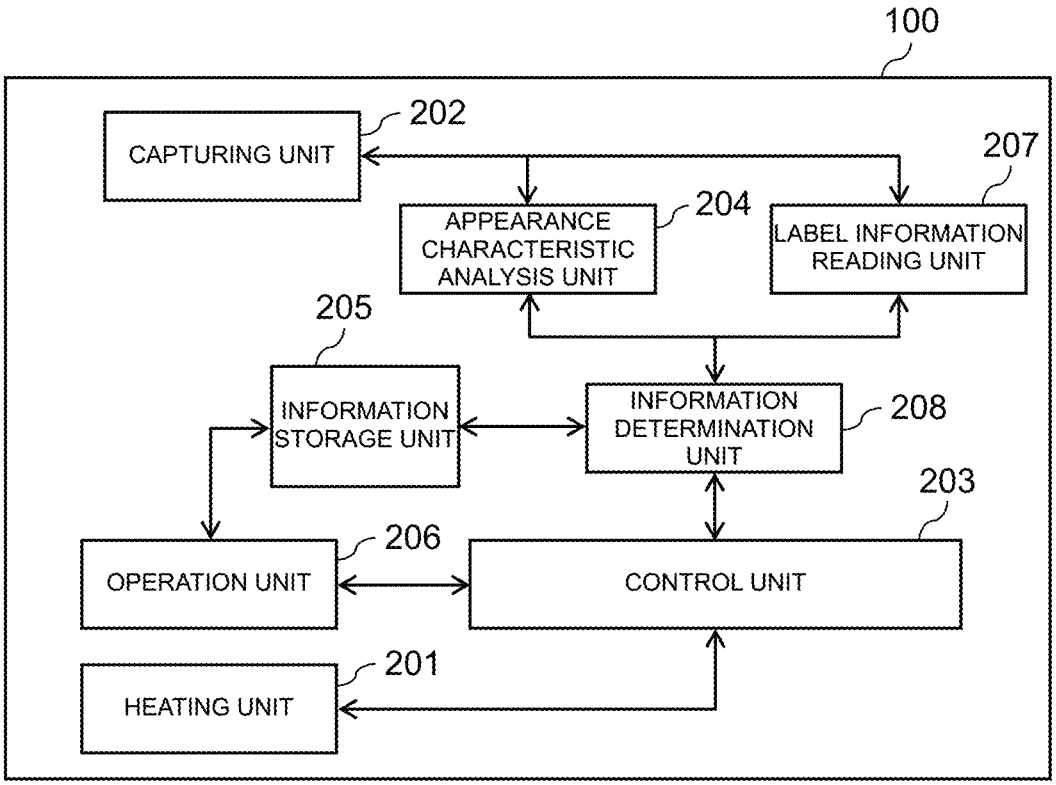
FIG. 2 is a block diagram of the heating cooker.

FIG. 2 is a block diagram of the heating cooker according to the present exemplary embodiment.

As shown in FIG. 2, heating cooker 100 includes heating unit 201, capturing unit 202, control unit 203, appearance characteristic analysis unit 204, information storage unit 205, operation unit 206, label information reading unit 207 for reading information from a label, and information determination unit 208.

Heating unit 201 is composed of, for example, magnetron, and supplies high-frequency waves to a food placed in heating cooking chamber 104 to heat the food.

Capturing unit 202 is constituted by, for example, a CMOS (Complementary Metal Oxide Semiconductor) image sensor, a CCD (Charge Coupled Device) image sensor, or the like, and captures the interior of heating cooking chamber 104. Capturing unit 202 includes camera 106 and the camera control circuit, which are described above.

Control unit 203 controls heating unit 201 based on an in-chamber state of heating cooking chamber 104 captured by capturing unit 202, heating control information of a target food, and the like. Control unit 203 controls heating unit 201, capturing unit 202, appearance characteristic analysis unit 204, information storage unit 205, operation unit 206, label information reading unit 207, and information determination unit 208.

Appearance characteristic analysis unit 204 extracts information of an appearance of a food from an image captured by capturing unit 202, analyzes the information, and quantifies the information. For example, an occupancy is used as an index for quantification. In addition to that, indexes obtained by quantifying one or a plurality of pieces of information such as a color of a food and a shape of a food may be used. In the present exemplary embodiment, the appearance characteristic include at least one of information itself about the appearance of a food and an index obtained by analyzing and quantifying the information.

The occupancy is an occupancy of a food in the chamber. Specifically, the occupancy is a value obtained by dividing an area of a food in an image captured by capturing unit 202 by a sum of the area of the food and an area of the bottom surface of heating cooking chamber 104. Alternatively, the occupancy may be a value obtained by dividing the area of a food in the image captured by capturing unit 202 by the area of the bottom surface of heating cooking chamber 104 in a capturing range of capturing unit 202. The area of the bottom surface of heating cooking chamber 104 in the capturing range of capturing unit 202 is stored in information storage unit 205 in advance. As described above, the occupancy is an index in proportion to a size of a food.

A method of extracting an appearance characteristic of a food based on differential information from information of an image showing a state where nothing is present in heating cooking chamber 104 is used. Alternatively, a method of extracting an outline of a food may be used.

Information storage unit 205 is constituted by, for example, a non-volatile memory such as a flash memory, and stores an appearance characteristic analyzed in appearance characteristics analysis unit 204, heating control information for executing heating control in control unit 203, a range of heating setting values determined in advance, and the like.

The heating control information includes the amount of heating (wattage) and a heating time based on the amount of heating. The heating control information includes at least a quantified index. The heating setting value is calculated from information included in the heating control information. Specifically, the heating setting value is a product of the amount of heating (W) and the heating time (a number of seconds of heating) based on the amount of heating.

Information storage unit 205 stores an appearance characteristic and a range of heating setting values expected from the appearance characteristic in a correlated manner.

The information stored in information storage unit 205 may include, in addition to the information of an appearance characteristic, the heating control information, and the range of heating setting values, information relating to heating control and operations such as setting information of heating cooker 100 or setting information of camera 106.

Operation unit 206 includes, for example, a touch panel or a plurality of keys as selection unit 103, and is used when a user sets a heating setting value or starts heating.

Label information reading unit 207 extracts an area corresponding a label (see FIGS. 4A and 4B to be described later) attached to a food from an image captured by capturing unit 202. In addition, label information reading unit 207 reads heating control information described in the label attached to the food from the image captured by capturing unit 202. As a method of extracting a label, a label may be extracted from the shape of a food or the outline of a label may be extracted from the whole image. If a label is attached to a substantially same position of a food to be heated and cooked, the label may be extracted based on a relative position of the label with respect to the shape of the food. The heating control information does not need to be described in a label and may be directly described in a food.

The heating control information described in a label attached to a food may be described as a two-dimensional information code such as a barcode or a QR code (registered trademark) or may be described as characters. A label may include, in addition to the heating control information, information such as a type of a food and a best-before date. Moreover, label information reading unit 207 may obtain the heating control information from information storage unit 205 based on the information such as the type of a food and a best-before date.

Information determination unit 208 reads a range of heating setting values (also referred to as an acceptable range of heating setting values) correlated with a corresponding appearance characteristic from information storage unit 205 based on an appearance characteristic analyzed in appearance characteristic analysis unit 204. The acceptable range of heating setting values may be set in advance. In addition, information determination unit 208 compares a heating setting value included in heating control information described in a label obtained by label information reading unit 207 to an acceptable range of heating setting values stored in information storage unit 205.

In the present exemplary embodiment, while the heating control information includes two values, that is, the amount of heating (W) and a heating time, the heating control information may include other values. The heating setting value is calculated from information included in the heating control information. While the heating setting value is a product of the amount of heating (W) and the heating time (the number of seconds of heating) based on the amount of heating in the present exemplary embodiment, the heating setting value may be a value obtained by other calculation methods.

When a heating setting value read by label information reading unit 207 is an acceptable value, that is, when a heating setting value read by label information reading unit 207 is included in an acceptable range of heating setting values, information determination unit 208 transmits heating control information to control unit 203.

On the other hand, when the heating setting value read by label information reading unit 207 is an unacceptable heating setting value, that is, when the heating setting value read by label information reading unit 207 is not included in an acceptable range of heating setting values, capturing unit 202 performs recapturing up to a predetermined number of times. Label information reading unit 207 rereads heating control information from a recaptured image. When a heating setting value included in the reread heating control information is included in the acceptable range of heating setting values, information determination unit 208 transmits the heating control information to control unit 203. On the other hand, when the heating setting value is not included in the acceptable range of heating setting values in spite of performing recapturing or rereading a predetermined number of times, a display for prompting a user to input information of the heating setting value is displayed on heating information display unit 102. For example, a message such as "please input heating time" is displayed on heating information display unit 102.

Alternatively, when the heating setting value read by label information reading unit 207 is not included in the acceptable range of heating setting values, a display for prompting a user to change a position of a food in heating cooking chamber 104 is displayed on heating information display unit 102. For example, a message such as "please change position of food and start again" is displayed. The display for prompting a user to change the position of a food may be displayed when the heating setting value read by label information reading unit 207 is not included in the acceptable range of heating setting values in spite of performing recapturing or rereading a predetermined number of times.

Label information reading unit 207 and information determination unit 208 may be a part of a configuration of control unit 203 and a part of a function of control unit 203.

A description will be given below of a process of reading an appearance characteristic of a food and heating control information from an image captured by capturing unit 202 and determining whether the heating control information is appropriate based on information correlated with the appearance characteristic for the purpose of executing heating control.

Figure 3A:
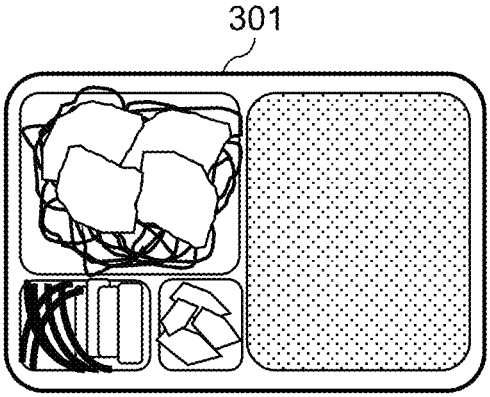
FIG. 3A shows a food that is heated and cooked by the heating cooker.
Figure 3B:
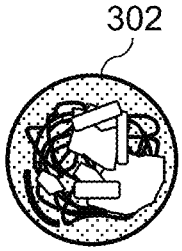
FIG. 3B shows a food that is heated and cooked by the heating cooker.

FIGS. 3A and 3B show images of a food, which is a recognition target, and an appearance of the food. Examples of a food to be heated by a heating cooker include a boxed lunch and a soup noodle. FIG. 3A shows a boxed lunch as food 301 whereas FIG. 3B shows a soup noodle as food 302.

Figure 4A:
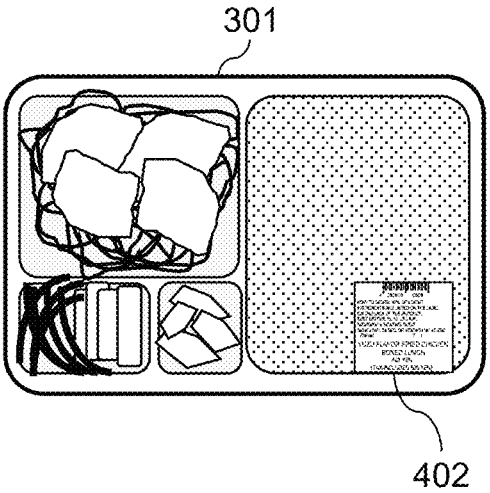
FIG. 4A shows the food and a label attached to the food.
Figure 4A:
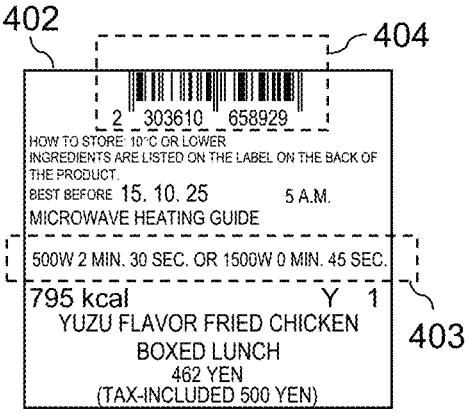
Figure 4B:
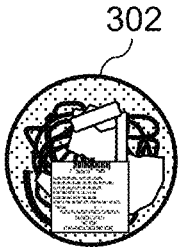
FIG. 4B shows the food and a label attached to the food.

FIGS. 4A and 4B show images of a food and a label attached to the food, illustrating an example of information code recognition and character recognition in an image recognition process. FIG. 4A shows food 301, which is a boxed lunch. Label 402 is attached to food 301. Character information about a name of a food and a price of the food and heating control information are displayed on label 402. The heating control information may be displayed on label 402 in a manner that the amount of heating and the heating time based on the amount of heating are directly recognized by a person, or may be displayed on label 402 as an information code corresponding to the amount of heating and the heating time based on the amount of heating.

The heating time based on the amount of heating is displayed on heating-control character target area 403 of label 402. Different heating times based on different amounts of heating are displayed on heating-control character target area 403. Specifically, the heating time when heating is performed by a normal domestic microwave oven, for example, when heating is performed with 500 W, and the heating time when heating is performed by a commercial microwave oven, for example, when heating is performed with 1500 W are displayed as a guide. That is, the heating time is displayed such as "500 W 2 min. 30 sec. or 1500 W 0 min 45 sec".

More specifically, a first character string that is numerical characters representing a predetermined amount of heating (for example, "500"), a second character string representing a unit for the amount of heating (for example, "W"), a third character string that is numerical characters representing a heating time with the amount of heating (for example, "2"), a fourth character string representing a unit for the heating time (for example, "min."), a fifth character string that is numerical characters representing the heating time with the amount of heating (for example, "30"), and a sixth character string representing the unit for the heating time (for example, "sec.") are displayed on heating-control character target area 403 in this order.

Moreover, a seventh character string that is numerical characters representing an amount of heating larger than the predetermined amount of heating (for example, "1500"), an eighth character string representing the unit for the amount of heating (for example, "W"), a ninth character string that is numerical characters representing the heating time with the amount of heating (for example, "0"), a tenth character string representing the unit for the heating time (for example, "min."), an eleventh character string that is numerical characters representing the heating time with the amount of heating (for example, "45"), and a twelfth character string representing the unit for the heating time (for example, "sec.") are displayed on heating-control character target area 403 in this order.

While "W", which is an SI unit representing the amount of heating, is used in the second and eighth character strings in the present exemplary embodiment, any other characters or units representing the unit of heating power may be used. While "min." and "sec.", which are the unit representing time, are used in the fourth, sixth, tenth, and twelfth character strings, any other characters or units representing the unit of time may be used.

An information code is displayed on information code target area 404.

label information reading unit 207 identifies label 402 of food 301, which is a boxed lunch, by an image captured by capturing unit 202 (for example, FIG. 5B to be described later). In addition, label information reading unit 207 extracts heating-control character target area 403 and information code target area 404 in label 402 from the image captured by capturing unit 202. Character recognition is performed in heating-control character target area 403 and information code recognition is performed in information code target area 404, so that heating control information is read. A same process is performed on food 302, which is a soup noodle. In the following description, a combined area of heating-control character target area 403 and information code target area 404 is referred to as a label area.

As shown in FIG. 4A, when two combinations of the amount of heating and the heating time based on the amount of heating are included as the heating control information, a heating setting value is calculated based on at least one of the combinations. For example, within a range of heating setting values in which heating cooker 100 can perform heating, a product of a larger amount of heating and a heating time based on the larger amount of heating may be determined as the heating setting value. Specifically, when heating cooker 100 can perform heating with 800 W, 500 W is selected as the amount of heating, and the heating setting value is "75000", which is a product of 500 (W) and 150 (sec.). Alternatively, a product of a larger amount of heating and a heating time based on the larger amount of heating may be simply set as the heating setting value. Specifically, 1500 W is selected as the amount of heating, and the heating setting value is "67500", which is a product of 1500 (W) and 45 (sec.). Alternatively, the heating setting value may be calculated for both combinations. Specifically, the heating setting value is "75000" and "67500".

Figure 5A:
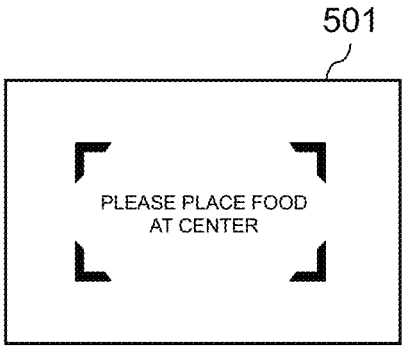
FIG. 5A shows an in-chamber image obtained by capturing a chamber of the heating cooker.
Figure 5B:
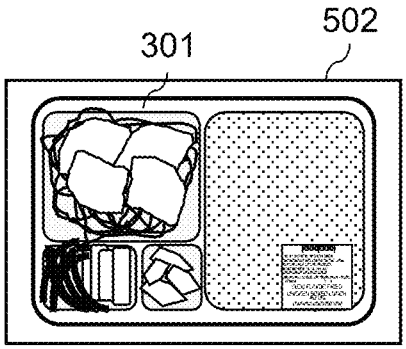
FIG. 5B shows an in-chamber image obtained by capturing the chamber of the heating cooker.
Figure 5C:
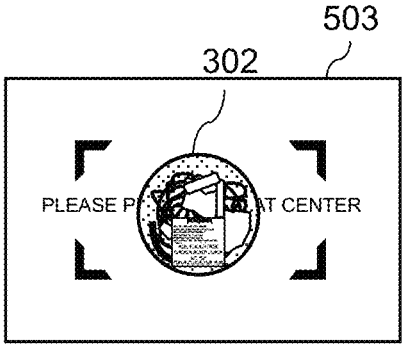
FIG. 5C shows an in-chamber image obtained by capturing the chamber of the heating cooker.

FIGS. 5A, 5B, and 5C show images within heating cooking chamber 104, which are captured by capturing unit 202. FIG. 5A shows in-chamber image 501 in a state where no food is placed in heating cooking chamber 104. FIG. 5B shows in-chamber image 502 in a state where food 301, which is a boxed lunch, is placed whereas FIG. 5C shows in-chamber image 503 in a state where food 302, which is a soup noodle, is placed.

FIG. 6 shows a table of correlations of an appearance characteristic and an acceptable range of heating setting values stored in information storage unit 205. As shown in FIG. 6, table 601 of correlations of an occupancy, which is an appearance characteristic, with an acceptable range of heating setting values is constituted by the occupancy (%), an acceptable lower limit value (amount of heating (W)× number of seconds of heating (sec.)), and an acceptable upper limit value (amount of heating (W)×number of seconds of heating (sec.)). The correlation of the occupancy with an acceptable range of heating setting values is set in advance for each store or the like with heating cooker 100, based on principal foods of foods determined by a store or the like to be hated by heating cooker 100.

Operations of appearance characteristic analysis unit 204, information determination unit 208, and control unit 203 are described using examples of FIGS. 5A, 5B, 5C, and 6.

A case where an image captured by capturing unit 202 is in-chamber image 501 is described first. For example, such a case is a case where a result of analyzing in-chamber image 501 by appearance characteristic analysis unit 204 is an occupancy of 0%. In this case, appearance characteristic analysis unit 204 determines that heating cooking chamber 104 is empty. Control unit 203 does not perform subsequent processes and ends this process.

Next, a case where an image captured by capturing unit 202 is in-chamber image 502 is described. For example, such a case is a case where a result of analyzing in-chamber image 502 by appearance characteristic analysis unit 204 is an occupancy of 75%. The occupancy of 75% corresponds to an occupancy of 60% to 90% in table 601 of correlations of an appearance characteristic with an acceptable range of heating setting values shown in FIG. 6. Information determination unit 208 sets the acceptable lower limit value, which is a lower limit of the acceptable range of heating setting values, to 30000 and the acceptable upper limit value, which is an upper limit of the acceptable range of heating setting values, to 210000. In this case, a case where label information reading unit 207 misreads a display on label 402 "500 W 2 min. 30 sec or 1500 W 0 min. 45 sec." for "500 W 0 min 30 sec." is further described. In this case, label information reading unit 207 calculates the amount of heating×the number of seconds of heating and sets a heating setting value to 15000. This heating setting value is lower than 30000, which is the acceptable lower limit value, and is too low for the occupancy, and thus information determination unit 208 determines that label information reading unit 207 misreads the label.

Next, a case where an image captured by capturing unit 202 is in-chamber image 503 is described. For example, such a case is a case where a result of analyzing in-chamber image 503 by appearance characteristic analysis unit 204 is an occupancy of 10%. The occupancy of 10% corresponds to an occupancy of 10% to 30% in the table of correlations of an appearance characteristic with an acceptable range of heating setting values shown in FIG. 6. Information determination unit 208 sets the acceptable lower limit value, which is the lower limit of the acceptable range of heating setting values, to 7000 and the acceptable upper limit value, which is the upper limit of the acceptable range of heating setting values, to 47000. In this case, a case where label information reading unit 207 correctly reads a display on a label is further described. In this case, the result of reading the display on the label is "500 W 0 min. 30 sec." which is the same as in in-chamber image 502, but the heating setting value calculated by label information reading unit 207, that is, 15000 is included in the acceptable range of heating setting values. For this reason, information determination unit 208 determines that label information reading unit 207 correctly reads the label.

While information determination unit 208 determines whether a heating setting value is within an acceptable range of heating setting values in the present exemplary embodiment, indexes other than the heating setting value may be used. For example, whether a heating time with a predetermined amount of heating is within an acceptable range may be determined. Specifically, a table of correlations of an appearance characteristic with an acceptable range includes a case where the amount of heating is 500 W and a case where the amount of heating is 1500 W. A lower limit heating time and an upper limit heating time with each amount of heating are stored in information storage unit 205. Information determination unit 208 compares a heating time read by label information reading unit 207 to a lower limit heating time and an upper limit heating time stored in information storage unit 205.

Moreover, while the occupancy in chamber is used as an index for a size of a food for the purpose of classification in the table of correlations of an appearance characteristic with an acceptable range in the present exemplary embodiment, values including an area may be used. A method of storing the table of correlations of an appearance characteristic with an acceptable range in information storage unit 205 is not limited to the case described above. For example, information input by a user through operation unit 206 may be tabularized for storage in information storage unit 205 or a table may be read from an external device wired or wirelessly connected to heating cooking chamber 104.

Figure 7:
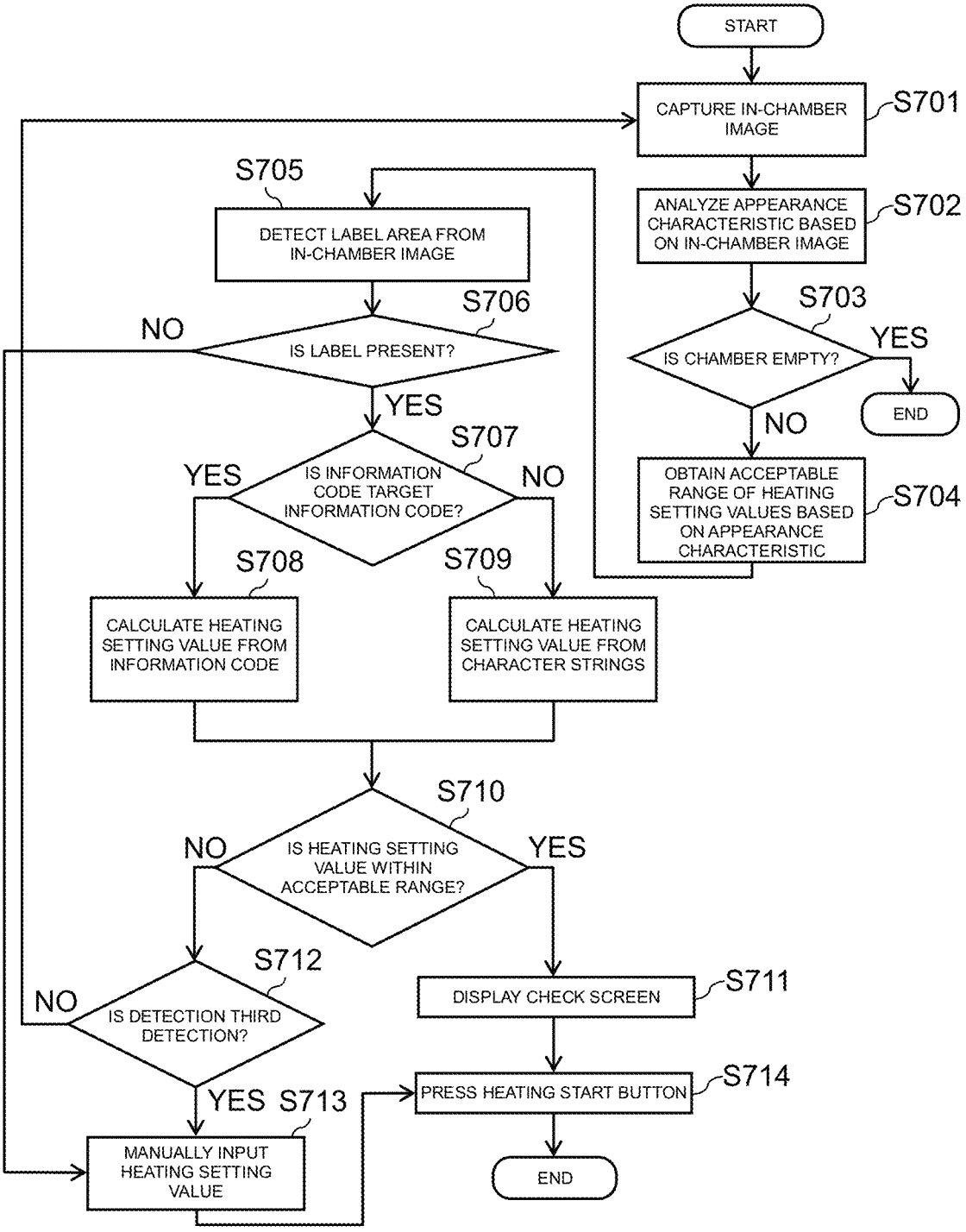
FIG. 7 is a flowchart of an image recognition process in the heating cooker.

FIG. 7 is a flowchart of an image recognition process in the present exemplary embodiment. An example of performing heating cooking based on a result of analyzing an appearance characteristic using an in-chamber image including a food, a heating setting value read from a label, and an acceptable range of heating setting values set in advance is described using the flowchart of FIG. 7.

In FIG. 7, when a food is placed in heating cooking chamber 104 and the chamber is in a recognizable state, capturing unit 202 captures an in-chamber image (step S701).

Appearance characteristic analysis unit 204 analyzes an appearance characteristic based on the image captured by capturing unit 202 (step S702).

When it is determined that the chamber is empty as a result of analyzing the appearance characteristic (YES at step S703), a heating process does not start and the process ends.

When it is determined that the chamber is not empty (NO at Step S703), control unit 203 obtains an acceptable range of heating setting values from information storage unit 205 based on data (an occupancy) analyzed by appearance characteristic analysis unit 204, and transmits a result (the occupancy and the acceptable range of heating setting values) to information determination unit 208 (step S704).

After analyzing the appearance characteristic, label information reading unit 207 starts to read heating control information of a label attached to a food. Firstly, to read the heating control information from the image captured by capturing unit 202 in label information reading unit 207, a label area in the image is identified (step S705).

When the label area is not identified in the image (NO at step S706), an amount of heating and a heating time cannot be automatically set, and thus the process proceeds to step S713. Heating setting is manually performed by operation unit 206 (step S713). For example, a display for prompting a user to input heating setting through operation unit 206 is displayed on heating information display unit 102. The user thus manually performs heating setting through operation unit 206.

On the other hand, the label area is identified in the image (YES at step S706), label information reading unit 207 determines whether an information code within the label area identified is an information code indicating heating control information (step S707).

When the information code in the label area is the information code indicating heating control information (YES at step S707), label information reading unit 207 reads the heating control information from the information code. A heating setting value is then calculated from values included in the heating control information (an amount of heating and a heating time based on the amount of heating) (step S708). The heating setting value is then transmitted to information determination unit 208.

When the information code in the label area is not the information code indicating heating control information (NO at step S707), heating-control character target area 403 within the label area is identified and heating control information is read. A heating setting value is then calculated from values included in the heating control information (an amount of heating and a heating time based on the amount of heating), and the heating setting value is transmitted to information determination unit 208 (step S709).

When the heating setting value is transmitted to information determination unit 208, it is determined whether the heating setting value obtained at step S708 or step S709 is within the acceptable range of heating setting values obtained at step S704 (step S710).

When the heating setting value read from the heating control information is within the acceptable range of heating setting values (YES at step S710), a check screen is displayed on heating information display unit 102 for the purpose of prompting the user to check whether the heating control information (at least one of the heating setting value and the heating time) is correct heating control information (at least one of the heating setting value and the heating time) for the food (step S711).

When the heating setting value read from the heating control information is out of the acceptable range of heating setting values (NO at step S710), label information reading unit 207 redetects the heating control information up to three times (step S712). While redetection is performed up to three times in the present exemplary embodiment, the present disclosure is not limited to this case. Redetection may be performed more than four times or zero times (that is, step S712 may be omitted). While redetection is performed when the heating setting value read from the heating control information is out of the acceptable range of heating setting values in the present exemplary embodiment, other operations may be performed. For example, redetection may be performed after a display for prompting the user to change a position of the food in the chamber is displayed on heating information display unit 102. Moreover, in a case of a heating cooking chamber including a turntable in the chamber, the turntable may be rotated for changing the position of the food and then redetection may be performed.

When redetection is performed three times, redetection is not performed anymore and heating setting is manually performed by operation unit 206 (step S713). For example, the display for prompting the user to input heating setting through operation unit 206 is displayed on heating information display unit 102. The user thus manually performs heating setting through operation unit 206.

When it is determined by the display at step S711 that the heating control information is correct heating control information for the food or when heating setting is manually performed by operation unit 206 at step S713, "heating start button" in operation unit 206 is pressed and then heating unit 201 starts heating cooking (step S714). Heating cooker 100 performs heating cooking with the amount of heating and the heating time based on the amount of heating that are included in the heating control information read from the label by label information reading unit 207. While heating cooker 100 performs heating cooking based on the heating control information read from the label by label information reading unit 207 in the present exemplary embodiment, the present disclosure is not limited to this case. Heating cooker 100 may perform heating cooking based on heating control information (an amount of heating, a heating time, and the like) that is stored in information storage unit 205 and corresponds to an appearance characteristic of a heated material.

While heating cooking starts when "heating start button" is pressed at step S714 in the present exemplary embodiment, heating cooking may automatically start when it is determined that heating control information is correct in view of reducing a burden of a user.

In heating cooker 100 according to the present exemplary embodiment, whether heating control information read by label information reading unit 207 is correct based on an acceptable range of heating control information that is stored in information storage unit 205 and is correlated with an appearance characteristic of a food. Consequently, if label information reading unit 207 misreads heating control information, a food is not heated and cooked based on wrong heating control information.

When heating control information read by label information reading unit 207 is not included in an acceptable range of heating control information that is stored in information storage unit 205 and is correlated with an appearance characteristic of a food, the heating control information is displayed on heating information display unit 102 to prompt a user to check the information. Reading accuracy of label information reading unit 207 is thus improved.

Moreover, when heating control information is clearly wrong, the heating control information is not displayed on heating information display unit 102 and rereading is performed automatically. A user can thus heat and cook a food without any stress.

Second Exemplary Embodiment

A microwave oven, which is an example of a heating cooker according to a second exemplary embodiment, is described. Descriptions of configurations or control methods that are similar to those of the first exemplary embodiment are omitted in the second exemplary embodiment. The second exemplary embodiment is different from the first exemplary embodiment in that whether heating control information read is appropriate is determined based on information correlated with a plurality of appearance characteristics. This is thus mainly described in the present exemplary embodiment.

Figure 8:
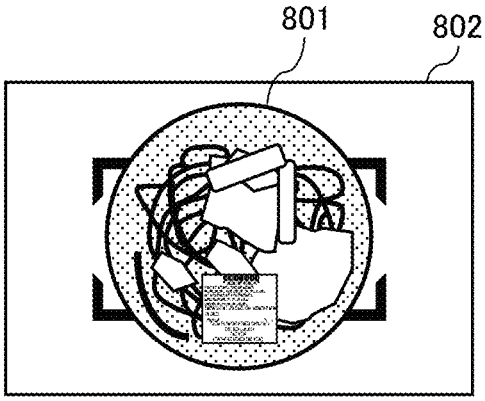
FIG. 8 shows a food and a label attached to the food in a second exemplary embodiment of the present disclosure.

FIG. 8 shows an in-chamber image captured by capturing unit 202. FIG. 8 shows in-chamber image 802 in which food 801 larger than food 302 of the first exemplary embodiment, which is a soup noodle, is placed in a chamber.

FIG. 9 shows a table of correlations of a plurality of appearance characteristics and acceptable ranges of heating setting values. Table 901 of correlations of an occupancy and a shape, which are appearance characteristics, with an acceptable range of heating setting values is constituted by an occupancy of a food (%), a shape of a food, an acceptable lower limit value, and an acceptable upper limit value. Correlation table 901 is formed by adding the shape of a food, which is an item of the appearance characteristic, to correlation table 601 described in the first exemplary embodiment. "Any" in correlation table 901 means that the shape may be any shape.

Operations of appearance characteristic analysis unit 204, information determination unit 208, and control unit 203 are described using examples of FIGS. 8 and 9.

For example, a description is given of a case where a result of analyzing in-chamber image 802 by appearance characteristic analysis unit 204 is an occupancy of 37% and the shape is circular. In correlation table 901, the occupancy of 37% corresponds to an occupancy of 30% to 60% and the shape corresponds to a circular shape. Information determination unit 208 thus sets the acceptable lower limit value to 45000 and the acceptable upper limit value to 180000. In this case, a case where label information reading unit 207 misreads a display on a label attached to food 801 for "500 W 1 min. 00 sec." is further described. In this case, label information reading unit 207 calculates the amount of heating×the number of seconds of heating and sets a heating setting value to 30000. This heating setting value is equal to or less than 45000, which is the acceptable lower limit value, and is too low for the occupancy and shape, and thus information determination unit 208 determines that label information reading unit 207 misreads the label.

As described in the first exemplary embodiment, if the information determination unit 208 makes the determination using correlation table 601 in which only the occupancy is correlated with an acceptable range of heating setting values, the acceptable lower limit value 15000 for an occupancy of 30% to 60% is compared to the heating setting value 30000, and thus it is determined that label information reading unit 207 reads the label correctly. However, a plurality of appearance characteristics are used in the present exemplary embodiment, and thus misreading of label information reading unit 207 is determined more precisely than in the first exemplary embodiment.

While a shape is added as an appearance characteristic in the present exemplary embodiment, another item may be added. Alternatively, a plurality of other items may be added. For example, a color of a food may be added as an appearance characteristic, which enables a food to be more precisely classified for the purpose of setting an acceptable range of heating setting values.

Third Exemplary Embodiment

A microwave oven, which is an example of a heating cooker according to a third exemplary embodiment, is described. Descriptions of configurations or control methods that are similar to those of the first exemplary embodiment are omitted in the third exemplary embodiment. The third exemplary embodiment performs, in addition to an aspect described in the first exemplary embodiment, a process performed when a food or an article that cannot be heated and cooked is placed in heating cooking chamber 104. This process is mainly described in the present exemplary embodiment.

Figure 10A:
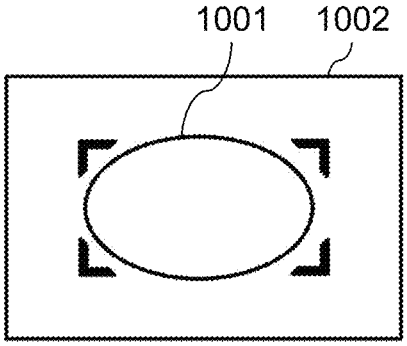
FIG. 10A shows an in-chamber image when a foreign matter is placed in a chamber.
Figure 10B:
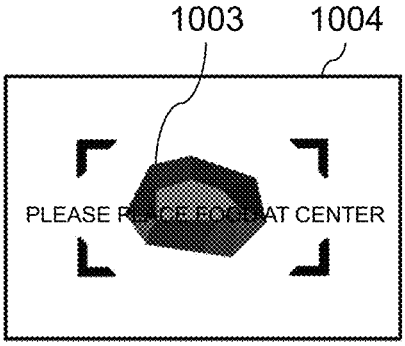
FIG. 10B shows an in-chamber image when a foreign matter is placed in the chamber.

A case where it is determined that a food cannot be heated and cooked is described with reference to FIGS. 10A and 10B. FIGS. 10A and 10B show examples of in-chamber images captured by capturing unit 202. FIG. 10A shows in-chamber image 1002 in which food 1001 with an oval shape, which is an example of a food that is determined to be incapable of being heated and cooked, is placed in a chamber. FIG. 10B shows in-chamber image 1004 in which stone 1003, which is another example, is placed in the chamber.

Shape information of food 1001 and stone 1003 that are not heating targets is correlated with heating control information that heating control is not executed and registered in information storage unit 205. An image recognition process when food 1001 or stone 1003 is put in heating cooking chamber 104 is described below. When food 1001 or stone 1003 is put in the chamber and the chamber is in a recognizable state, capturing unit 202 captures an in-chamber image. Appearance characteristic analysis unit 204 extracts shape information of food 1001 or stone 1003 from the image captured by capturing unit 202 and obtains the shape information. Control unit 203 determines that the shape information extracted by appearance characteristic analysis unit 204 corresponds to information of food 1001 or stone 1003, which is stored in information storage unit 205. Further, control unit 203 obtains the heating control information that food 1001 or stone 1003 cannot be heated and cooked from information storage unit 205. A content of the heating control information that heating control is not executed on food 1001 or stone 1003 is notified to a user by a method to be described later. If a heating start button is pressed by the user, control unit 203 does not execute heating control.

Examples of food 1001 that is not a heating target include food that cannot be heated by microwave ovens, such as canned foods.

Figure 10C:
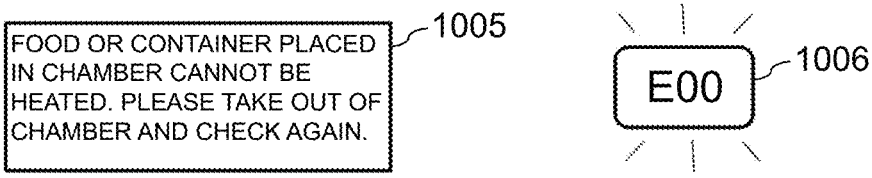
FIG. 10C shows an error display that is displayed when a foreign matter is placed in the chamber.

FIG. 10C shows an example of an aspect of notifying a user that a food that is not a heating target is placed in a chamber of heating cooker 100. In this case, the user is notified that heating cooking is impossible by reading a message by voice, displaying a message on display unit 1005 that is an example of heating information display unit 102, or flashing display unit 1006 that is another example of heating information display unit 102. A specific example of the message is "Food or container placed in chamber cannot be heated. Please take out of chamber and check again."

Figure 11:
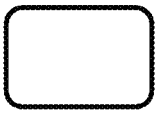
FIG. 11 shows a table of correlations of a plurality of appearance characteristics with ranges of heating set values in a heating cooker according to a third exemplary embodiment of the present disclosure.
Figure 11:
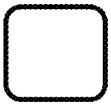
Figure 11:
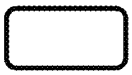
Figure 11:
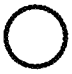

FIG. 11 shows a table of correlations of an appearance characteristic and an acceptable range of heating setting values according to the present exemplary embodiment. Correlation table 1101 of a color of a container, a shape of a container, and an occupancy, which are appearance characteristics, with an acceptable range of heating setting values is constituted by a color of a container, a shape of a container, an occupancy (%), an acceptable lower limit value, and an acceptable upper limit value. Correlation table 1101 is formed by adding the color of a container, which is an item of the appearance characteristic, to correlation table 901 described in the second exemplary embodiment. When heating cooking is impossible, the acceptable lower limit value and the acceptable upper limit value are represented as "-" (hyphen).

Operations of appearance characteristic analysis unit 204, information determination unit 208, and control unit 203 are described using examples of FIGS. 10A, 10B, 10C, and 11.

For example, a description is given of a case where as a result of analyzing in-chamber image 1002 by appearance characteristic analysis unit 204, a color of a container is white and a shape of the container is a shape other than a specified shape. In this case, the acceptable lower limit value and the acceptable upper limit value are represented as a hyphen. That is, information determination unit 208 determines that heating cooking itself is impossible. Control unit 203 then displays a message that heating cooking is impossible on display unit 1005 or display unit 1006.

A description is given of a case where as a result of analyzing in-chamber image 1004 by appearance characteristic analysis unit 204, the color of a container is black. In this case, at a time when it is determined that the color of the container is black, information determination unit 208 does not handle an article placed in the chamber as a target for heating cooking. As in the case of in-chamber image 1002, it is determined that heating cooking itself is impossible. Control unit 203 then displays a message that heating cooking is impossible on display unit 1005 or display unit 1006.

While a shape and color of a container are added as appearance characteristics in the present exemplary embodiment, other items may be added. For example, it may be determined that heating cooking is impossible when a certain mark is recognized. Consequently, if a user puts an article that must not be heated in ordinary cases in heating cooker 100 by mistake, it is possible to prevent heating cooker 100 from heating the article. Example of the certain mark includes a trademark of a store other than a store where heating cooker 100 is installed.

A part of each of the first to third exemplary embodiments described above may be changed as follows. Modifications described below are not applied to only the exemplary embodiments and may be implemented in combinations.

Not the shape of a food but the shape of a label attached to the food may be used as an appearance characteristic.

A heating cooker may be connectable to a network, and the present disclosure may be implemented as a heating cooking system of controlling the heating cooker by an external device on the network (a mobile terminal, a server, or the like). In such a heating cooking system, a recognition process or the like is performed on a side of the mobile terminal or the server.

Figure 12:
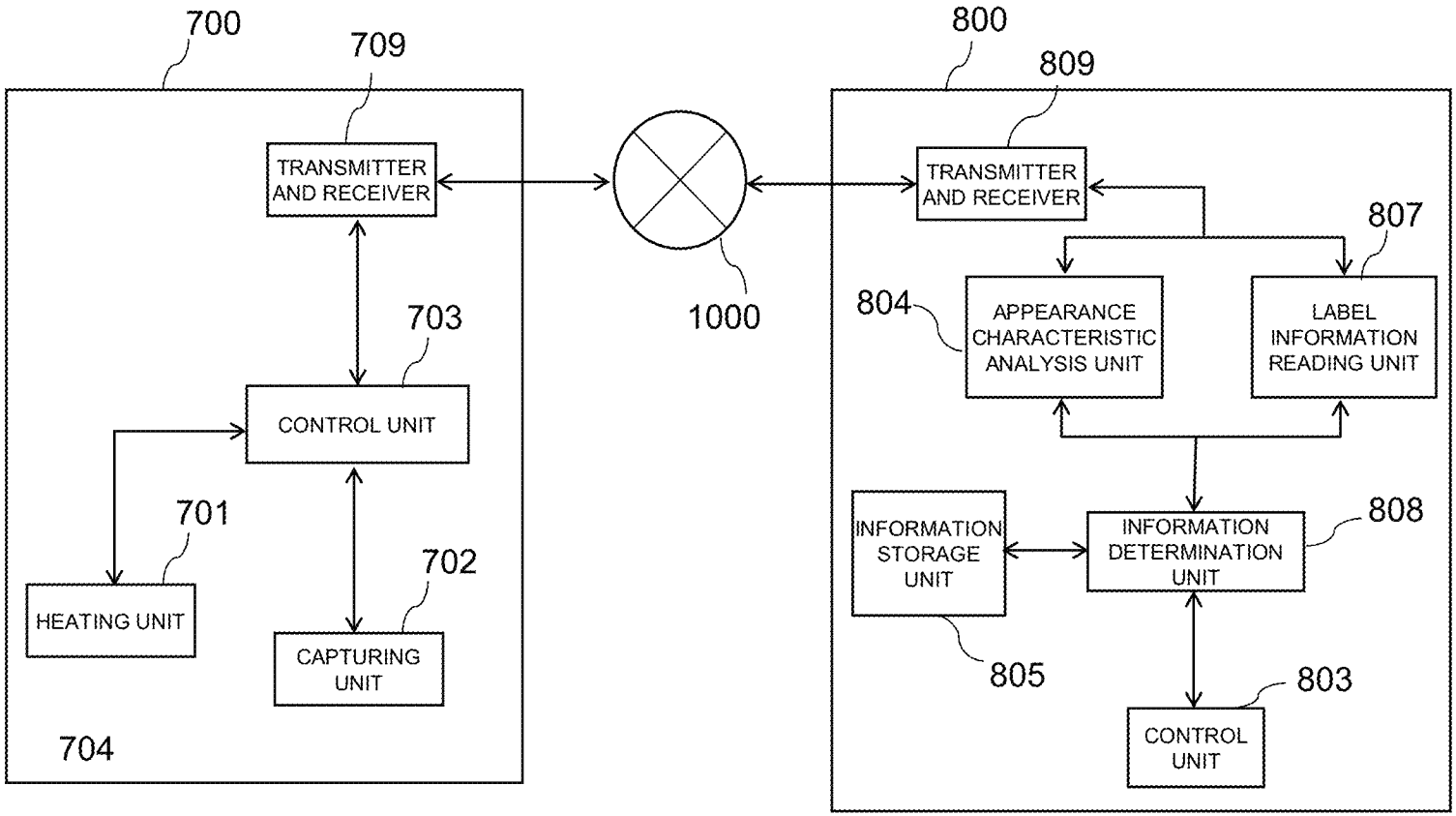
FIG. 12 is a block diagram of a heating cooking system according to the present disclosure.

More specifically, as shown in FIG. 12, heating cooker 700 is connected via Internet 1000 to external device 800.

Heating cooker 700 includes heating chamber 704, capturing unit 702 that captures heating chamber 704, heating unit 701 that heats a heated material in heating chamber 704, control unit 703 that controls at least heating by heating unit 701, and transmitter and receiver 709 that transmits an image captured by capturing unit 702 to external device 800 and receives a result of determination by information determination unit 808 from external device 800.

External device 800 includes appearance characteristic analysis unit 804 that analyzes an appearance characteristic of a heated material based on an image that is captured by capturing unit 702 and received by transmitter and receiver 809, label information reading unit 807 that reads heating control information applied to the heated material from the image that is captured by capturing unit 702 and received by transmitter and receiver 809, information storage unit 805 in which an acceptable range of heating control information corresponding to an appearance characteristic is registered, information determination unit 808 that determines whether the heating control information read by label information reading unit 807 is within an acceptable range, and transmitter and receiver 809 that receives an image from heating cooker 700 and transmits a result of determination by information determination unit 808 to heating cooker 700. In transmitters and receivers 709, 809, a transmission unit and a reception unit may be configured separately. In the present exemplary embodiment, steps S701, S711, S713, and S714 in FIG. 7 are performed on a side of heating cooker 700. Other steps are performed on a side of external device 800.

As other exemplary embodiments, it may be configured that only information storage unit 805 is provided in an external device and other components are provided on a side of a heating cooker.

It is permissible that the heating cooker is not a commercial device for convenience stores or boxed lunch stores but a domestic heating cooker.

An image of a heating chamber captured by a capturing unit may be displayed on a display unit included in a heating cooker. When the present disclosure is implemented as a heating cooking system including a heating cooker connected to a network, the image of the heating chamber may be displayed on a display unit of a mobile terminal connected to the network.

Characters, barcodes, and shapes of foods recognized by a heating cooker may be displayed on a display unit included in the heating cooker. When the present disclosure is implemented as the heating cooking system including a heating cooker connected to a network, characters and shapes recognized by the heating cooker may be displayed on a display unit of a mobile terminal connected to the network.

In all the functional blocks or a part of the functional blocks in the present disclosure, any configuration may be physically possible. All the functional blocks or a part of the functional blocks in the present disclosure may be configured to include an arithmetic processing unit and a storage unit that stores a control program. Examples of the arithmetic processing unit include an MPU (Micro Processing Unit) and a CPU (Central Processing Unit). An example of the storage unit is a memory. The control program recorded in the storage unit is executed by the arithmetic processing unit. All the functional blocks or a part of the functional blocks in the present disclosure may be performed by hard logic. When all the functional blocks or a part of the functional blocks in the present disclosure are performed by hard logic, it is effective to increase a processing speed. All the functional blocks or a part of the functional blocks in the present disclosure may be constituted by a semiconductor chip or may be physically constituted by a plurality of semiconductor chips. When all the functional blocks or a part of the functional blocks are constituted by a plurality of semiconductor chips, different controls described above may be achieved by different semiconductor chips. When a plurality of functional blocks are performed by a semiconductor element, not only various processes can be performed by a control unit but also a number of semiconductor elements mounted on a circuit board can be reduced. As a result, a size of the circuit board can be reduced.

As described above, heating cooker 100 according to a first aspect includes heating chamber 200, heating unit 201 that heats a heated material in heating chamber 200, capturing unit 202 that captures heating chamber 200, control unit 203 that controls at least heating by heating unit 201, appearance characteristic analysis unit 204 that analyzes an appearance characteristic of the heated material based on an image captured by capturing unit 202, information reading unit 207 that reads heating control information applied to the heated material from the image captured by capturing unit 202, information storage unit 205 in which an acceptable range of the heating control information corresponding to the appearance characteristic is registered, and information determination unit 208 that determines whether the heating control information read by information reading unit 207 is within the acceptable range. When the heating control information read by information reading unit 207 is within the acceptable range, control unit 203 executes heating control based on the heating control information read by information reading unit 207. When the heating control information read by information reading unit 207 is not within the acceptable range, control unit 203 does not execute heating control based on the heating control information read by information reading unit 207.

Heating control information described in a label is not simply read, and an acceptable range of the heating control information assumed from an appearance characteristic of a food is added. Consequently, recognition precision is improved and a user heats and cooks a food without any stress.

According to a second aspect, the heating control information and the acceptable range of the heating control information are registered in information storage unit 205 so as to correspond to a plurality of the appearance characteristics of the heated material.

As a food is classified precisely, the recognition precision is further improved and a user can heat and cook a food without any stress.

According to a third aspect, when information determination unit 208 determines that heating by heating unit 201 is impossible with respect to the appearance characteristic, control unit 203 does not execute heating control.

It is thus possible to keep a child out of mischief. Further, it is possible to prevent a heating cooker from being used for heating a food that is not related to those in a store having the heating cooker installed therein.

According to a fourth aspect, there is provided a heating cooking system that includes heating cooker 700 that heats a food and external device 800 that is communicably connected to heating cooker 700. Heating cooker 700 includes heating chamber 704, capturing unit 702 that captures heating chamber 704, control unit 703 that controls at least heating of a heated unit, and transmitter and receiver 709 that transmits an image captured by capturing unit 702 to external device 800. External device 800 includes appearance characteristic analysis unit 804 that analyzes an appearance characteristic of the heated material based on an image captured by capturing unit 702, information reading unit 807 that reads heating control information applied to the heated material from the image captured by capturing unit 702, information storage unit 805 in which an acceptable range of the heating control information corresponding to the appearance characteristic is registered, information determination unit 808 that determines whether the heating control information read by information reading unit 807 is within the acceptable range, and transmitter and receiver 809 that transmits a result of determination by information determination unit 808 to heating cooker 700. When the heating control information read by information reading unit 807 is within the acceptable range, control unit 703 executes heating control based on the heating control information read by information reading unit 807. When the heating control information read by information reading unit 807 is not within the acceptable range, control unit 703 does not execute heating control based on the heating control information read by information reading unit 807.

Heating control information described in a label is not simply read, and an acceptable range of the heating control information assumed from an appearance characteristic of a food is added. Consequently, the recognition precision is improved and a user heats and cooks a food without any stress.

A fifth aspect is a method of controlling the heating cooker of the first aspect.

Heating control information described in a label is not simply read, and an acceptable range of the heating control information assumed from an appearance characteristic of a food is added. Consequently, the recognition precision is improved and a user heats and cooks a food without any stress.

INDUSTRIAL APPLICABILITY

A heating cooker, a method of controlling a heating cooker, and a heating cooking system according to the present disclosure are widely applicable to heating cookers such as microwave ovens that perform capturing using cameras to recognize characters and shapes, and reflect a result of recognition to heating control.

REFERENCE MARKS IN THE DRAWINGS

100, 700: heating cooker
101: door panel
102: heating information display unit
103: selection unit
104: heating cooking chamber
105: illumination unit
106: camera
107, 301, 302, 303, 801, 1001: food
200, 704: heating chamber
201, 701: heating unit
202, 702: capturing unit
203, 703: control unit
204, 804: appearance characteristic analysis unit
205, 805: information storage unit
206: operation unit
207, 807: label information reading unit (information reading unit)
208, 808: information determination unit
709, 809: transmitter and receiver
402: label
403: heating-control character target area
404: information code target area
501, 502, 503, 802, 1002, 1004: in-chamber image
1003: stone
1005, 1006: display unit
800: external device

The invention claimed is:

1. A heating cooker comprising:
a heating chamber;
a heater that heats a heated material in the heating chamber;
an image sensor that captures the heating chamber;
a label information reader configured to read a heating control information on a label of the heated material from the image captured by the image sensor;
an information storage in which an acceptable range of the heating control information corresponding to an appearance characteristic is registered, wherein the acceptable range includes a value obtained by a product of electric power and cooking time; and
a controller that controls at least heating by the heater and includes a processor and memory storing a control program, wherein the control program, when executed by the processor, causes the controller to perform:
analyzing an appearance characteristic of the heated material based on an image captured by the image sensor; and
determining whether the heating control information read by the label information reader is within the acceptable range corresponding to the heating control information in the information storage,
wherein when the heating control information read by the label information reader is within the acceptable range, the controller executes heating control based on the heating control information read by the label information reader, and
when the heating control information read by the label information reader is not within the acceptable range, the controller does not execute heating control based on the heating control information read by the label information reader.

2. The heating cooker according to claim 1, wherein the heating control information and the acceptable range of the heating control information are registered in the information storage so as to correspond to a plurality of the appearance characteristics of the heated material.

3. The heating cooker according to claim 1, wherein:
the appearance characteristic comprises an occupancy of an item to be heated, and
in the information storage, the acceptable range of the heating control information and a corresponding occupancy range are registered.

4. The heating cooker according to claim 1, wherein:
the appearance characteristic further comprises a shape of an item to be heated, and
in the information storage, the acceptable range of the heating control information, a corresponding occupancy range and a corresponding shape are registered.

5. The heating cooker according to claim 1, wherein the value comprises a lower limit and an upper limit of the acceptable range.

6. A heating cooking system comprising:
a heating cooker that heats a food; and
an external device that is communicably connected to the heating cooker, wherein:
the heating cooker includes
a heating chamber,
an image sensor that captures the heating chamber,
a label information reader configured to read a heating control information on a label of the heated material from the image captured by the image sensor,
an information storage in which an acceptable range of the heating control information corresponding to an appearance characteristic is registered, wherein the acceptable range defines a value obtained by a product of electric power and cooking time,
a controller that controls at least heating of the heated material, and
a transmitter and a receiver that transmits an image captured by the image sensor to the external device,
the external device includes a processor and a memory storing a program, and the program, when executed by the processor, causes the external device to perform:

analyzing an appearance characteristic of the heated material based on an image captured by the image sensor, determining whether the heating control information read by the label information reader is within the acceptable range corresponding to the heating control information in the information storage, and transmitting a result of determination to the heating cooker, and when the heating control information read by the label information reader is within the acceptable range, the controller executes heating control based on the heating control information read by the label information reader, and when the heating control information read by the label information reader is not within the acceptable range, the controller does not execute heating control based on the heating control information read by the label information reader.

7. The heating cooking system according to claim 6, wherein the value comprises a lower limit and an upper limit of the acceptable range.

* * * * *